US009815612B1

(12) United States Patent
Caruso

(10) Patent No.: US 9,815,612 B1
(45) Date of Patent: Nov. 14, 2017

(54) FLIP-TOP BUSHING FOR AEROSOL CANISTER WITH MOLDED ACTUATOR SPRING

(71) Applicant: Avanti USA Ltd., Tonawanda, NY (US)

(72) Inventor: Albert P. Caruso, Tonawanda, NY (US)

(73) Assignee: Avanti USA Ltd., Tonawanda, NY (US)

( * ) Notice: Subject to any disclaimer, the term of this patent is extended or adjusted under 35 U.S.C. 154(b) by 0 days.

(21) Appl. No.: 15/177,861

(22) Filed: Jun. 9, 2016

(51) Int. Cl.
*B65D 83/00* (2006.01)
*B65D 83/20* (2006.01)
*B65D 83/40* (2006.01)

(52) U.S. Cl.
CPC ..... *B65D 83/205* (2013.01); *B65D 83/40* (2013.01)

(58) Field of Classification Search
CPC ..... B65D 83/206; B65D 83/205; B65D 83/40
USPC ..... 222/301.13, 401.11, 153.02, 402.13, 222/402.11, 402.1, 402.15
See application file for complete search history.

(56) References Cited

U.S. PATENT DOCUMENTS

| | | | | |
|---|---|---|---|---|
| 6,398,082 | B2 | 6/2002 | Clark et al. | |
| 6,932,246 | B2 | 8/2005 | Crosnier et al. | |
| 7,121,434 | B1 * | 10/2006 | Caruso | B65D 83/56 222/402.13 |
| 8,765,850 | B2 | 7/2014 | Iwamoto et al. | |
| 8,978,937 | B2 | 3/2015 | Chamber et al. | |
| 9,120,606 | B2 | 9/2015 | Walter et al. | |
| 9,174,229 | B2 | 11/2015 | Smith | |
| 9,199,784 | B2 * | 12/2015 | Caruso | B65D 83/384 |
| 2008/0029551 | A1 | 2/2008 | Lombardi | |
| 2009/0255958 | A1 * | 10/2009 | Santoni | B05B 11/0008 222/321.1 |
| 2010/0155427 | A1 * | 6/2010 | Lilienthal | B65D 83/205 222/182 |
| 2010/0206246 | A1 | 8/2010 | Waldrep | |
| 2011/0006083 | A1 * | 1/2011 | Walters | B65D 83/206 222/153.11 |
| 2011/0303767 | A1 | 12/2011 | Smith | |
| 2012/0325861 | A1 | 12/2012 | Pardonge | |
| 2015/0329252 | A1 | 11/2015 | Walter et al. | |

(Continued)

FOREIGN PATENT DOCUMENTS

| | | |
|---|---|---|
| CN | 103980592 | 8/2014 |
| GB | 1362492 | 8/1974 |
| JP | 20140051586 | 10/2015 |

*Primary Examiner* — Lien Ngo
(74) *Attorney, Agent, or Firm* — Simpson & Simpson, PLLC

(57) ABSTRACT

A pivot-spring assembly for dispersing contents from an aerosol canister, comprising a cover having an opening, a lid having at least one arm, a pivot-spring operatively arranged in the cover to rotatably secure the lid to the cover, and an actuator having a nozzle and non-rotatably secured on the pivot-spring. The actuator operatively arranged to engage a stem of the aerosol canister and disperse contents from the aerosol canister. The pivot-spring comprises a flexible tongue having an elongated slot, at least one lid tab operatively arranged to at least partially enclose the at least one arm, at least one dowel, and at least one guide, wherein the flexible tongue, the at least one lid tab, the at least one dowel, and the at least one guide are vertically arranged on a flange.

12 Claims, 9 Drawing Sheets

(56) References Cited

U.S. PATENT DOCUMENTS

| | | | |
|---|---|---|---|
| 2015/0344214 | A1 | 12/2015 | Yamaguchi et al. |
| 2016/0059247 | A1 | 3/2016 | Smith |

* cited by examiner

FLIP-TOP BUSHING FOR AEROSOL CANISTER WITH MOLDED ACTUATOR SPRING

TECHNICAL FIELD

The invention relates generally to a case for an aerosol canister, and, more specifically, to a flip-top bushing for an aerosol canister and, even more specifically, to a molded actuator spring mechanism for a flip-top bushing for an aerosol canister.

BACKGROUND

Cases for aerosol or spray canisters typically include an actuator to engage the stem of the canister in order to dispel the canister's contents. There are a variety of aerosol dispensers that are used in many applications which include dispensing perfume, air fresheners, personal hygiene products, covering an article with a coat of paint, and dispensing cleaning products, amongst others. One specific application for an aerosol dispenser is as a personal defense device that, for example, directs a chemical repellant spray towards a potential human or animal threat.

Typical lids for dispensing actuators or cases for aerosol and spray canisters are intended to either prevent accidental discharge or provide easy dispensing. With respect to personal defense devices, easy dispensing is crucial to ensure the safety of the user when a threat presents itself. However, the reason personal defense devices are effective is because their chemical contents are indiscriminately extremely painful to anyone who comes into contact with it.

U.S. Patent Application Publication No. 2010/0206246 discloses a retractable animal leash combined with a pepper spray dispenser. The pepper spray dispenser includes a tube that provides a path for spray from the canister to pass through the housing and into the atmosphere. A trigger activates the spray canister, which has a safety cover. The publication discloses a dispensing nozzle mechanism that releasably attaches to the canister and connects the dispenser region through the trigger to a dispensing tube, which leads through the housing to a dispensing spout to direct the pepper spray forward when the trigger is actuated. The application does not disclose the four-piece activation system of the present invention, specifically the pivot-spring. In addition, this dispensing actuator requires various movements by the user to spray the contents of the container and return the dispensing actuator to its original position. Opening the lid, accurately positioning the user's finger over the actuator, depressing the actuator, and then manually closing the lid is cumbersome, time consuming, and possibly dangerous in that the potential victim might not activate the device in time to thwart the threat.

Therefore, there is a long-felt need for an improved case for an aerosol or spray canister that minimizes the number of movements to dispel the canister's contents under pressure. There is also a long-felt need for a case that is simple to reassemble if it breaks. Further, there is also a long-felt need for a spring mechanism used in a flip top case that can be made of plastic in order to minimize manufacturing costs.

SUMMARY

The present invention comprises a pivot-spring assembly for dispersing contents from an aerosol canister, comprising a cover having an opening, a lid having at least one arm, a pivot-spring operatively arranged in the cover to rotatably secure the lid to the cover, and an actuator having a nozzle and non-rotatably secured on the pivot-spring. The actuator operatively arranged to engage a stem of the aerosol canister and disperse contents from the aerosol canister. The pivot-spring comprises a flexible tongue having an elongated slot, at least one lid tab operatively arranged to at least partially enclose the at least one arm, at least one dowel, and at least one guide, wherein the flexible tongue, the at least one lid tab, the at least one dowel, and the at least one guide are vertically arranged on a flange.

The present invention comprises a case for a canister capable of dispelling material, comprising a main body to house the canister, the main body having a front aperture, a top lid to cover the main body, a spring non-rotatably secured to the main body and rotatably secured to the top lid. The spring comprising a flexible tongue having an elongated slot, at least one lid tab operatively arranged to at least partially enclose the at least one arm, at least one dowel, and at least one guide, wherein the flexible tongue, the at least one lid tab, the at least one dowel, and the at least one guide are vertically arranged on a flange, and an actuator to direct dispelled material from the canister out of the main body through the front aperture.

These and other objects, advantages and features of the present invention will be better appreciated by those having ordinary skill in the art in view of the following detailed description of the invention in view of the drawings.

BRIEF DESCRIPTION OF THE DRAWINGS

The nature and mode of operation of the present invention will now be more fully described in the following detailed description of the invention taken with the accompanying figures, in which.

DETAILED DESCRIPTION

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, and/or pneumatics.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

By "non-rotatably connected" elements, we mean that: the elements are connected so that whenever one of the elements rotate, all the elements rotate; and relative rotation between the elements is not possible. Radial and/or axial movement of non-rotatably connected elements with respect to each other is possible, but not required.

Figure 1A:
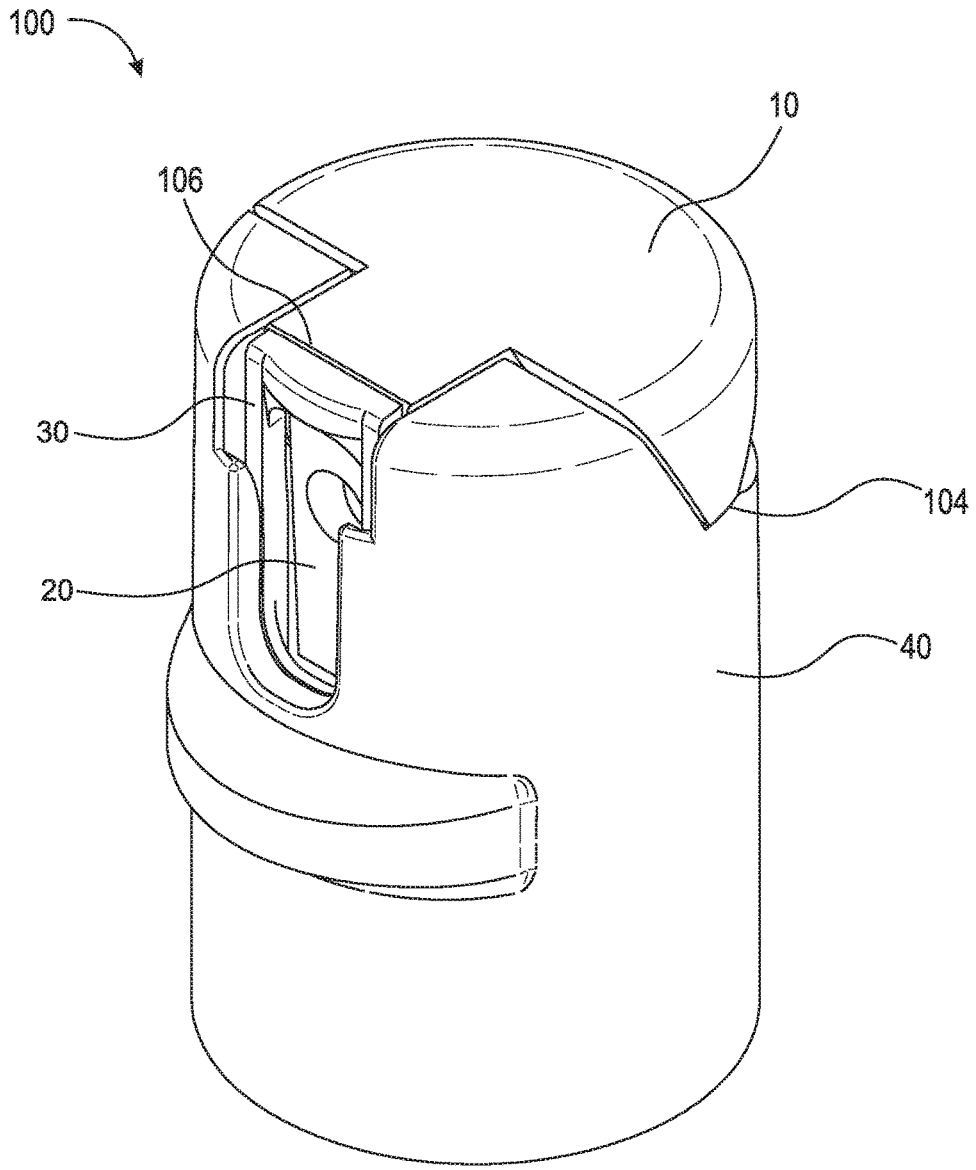
FIG. 1A is a front perspective view of a flip-top assembly, with the lid closed, in accordance with an embodiment of the present invention.

Adverting now to the figures, FIG. 1A is a front perspective view of flip-top assembly 100 with lid 10 closed, in accordance with an embodiment of the present invention. Flip top assembly 100 comprises lid 10, actuator 20, pivot-spring 30, and cover 40. Lid 10 engages cover 40 at interface 104. Lid 10 engages pivot-spring 30 at spring interface 106. Actuator 20 is assembled on pivot-spring 30, which is fed into cover 40 and secures lid 10. Flip-top assembly 100 and its components are preferably made out of molded plastic, however, any other suitable material, such as metal, rubber, elastomeric material, or a combination of materials among its components may be used.

Figure 1B:
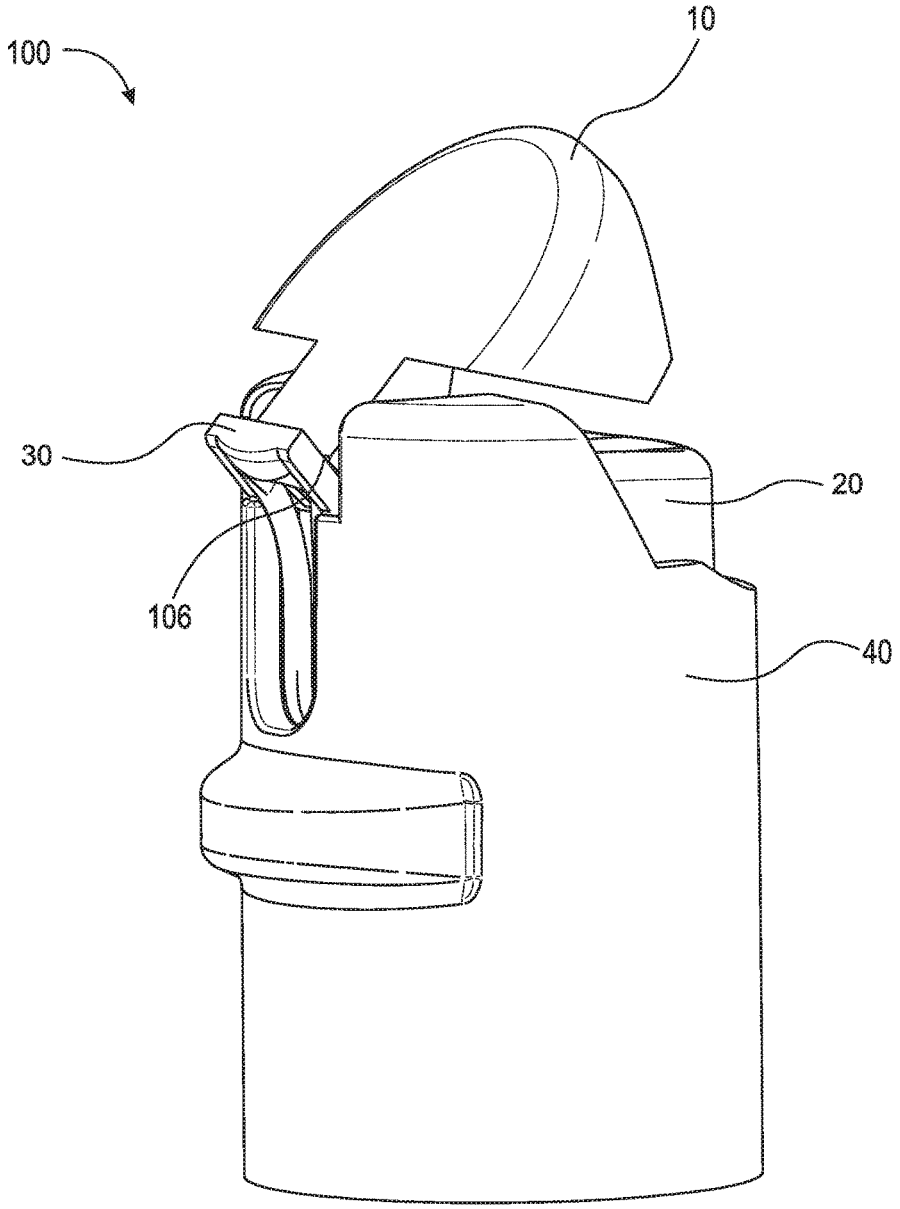
FIG. 1B is a front perspective view of a flip-top assembly, with the lid open, in accordance with an embodiment of the present invention.

FIG. 1B is a front perspective view of flip-top assembly 100, with lid 10 open, in accordance with an embodiment of the present invention. When opened, lid 10 disengages cover 40 at interface 104. In addition, lid 10 forces pivot-spring 30 forward at interface 106. Pivot-spring 30 resists this forward movement, thus biasing lid 10 back to the closed position.

Figure 2:
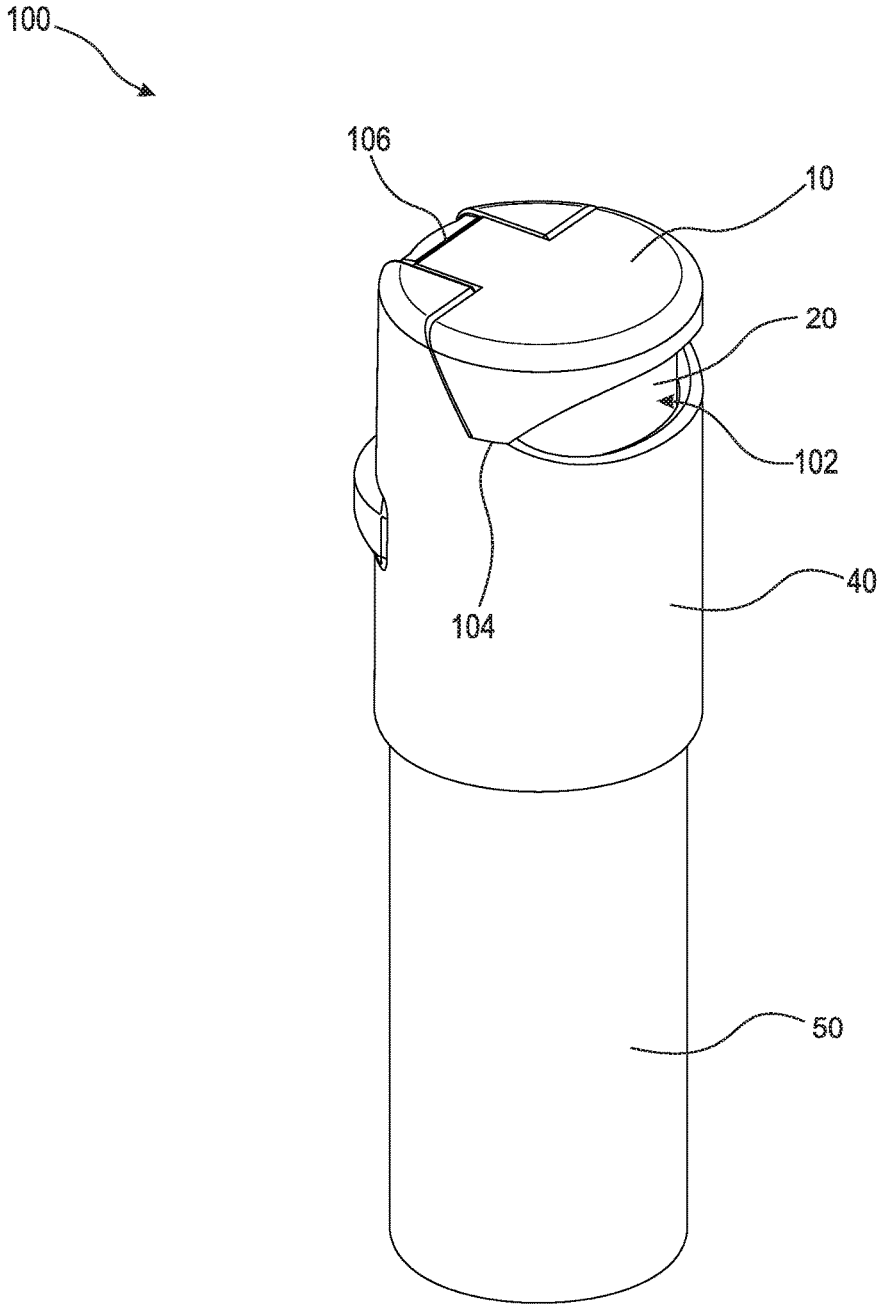
FIG. 2 is a rear perspective view of a flip-top assembly arranged on an aerosol canister, in accordance with an embodiment of the present invention.

FIG. 2 is a rear perspective view of flip-top assembly 100 on aerosol canister 50, in accordance with an embodiment of the present invention. In this exemplary embodiment, flip-top assembly 100 is dimensioned with an axial length and a radius to engage a canister of pepper spray. It should be appreciated, however, that flip-top assembly 100 can have dimensions to suitably engage any type of canister. Rear opening 102 is generally ellipsoidal in shape with its top arcuate curve defined by lid 10 and its bottom arcuate curve defined by cover 40. Lid 10 engages cover 40 at interface 104. Lid 10 engages pivot-spring 30 at spring interface 106.

Figure 3A:
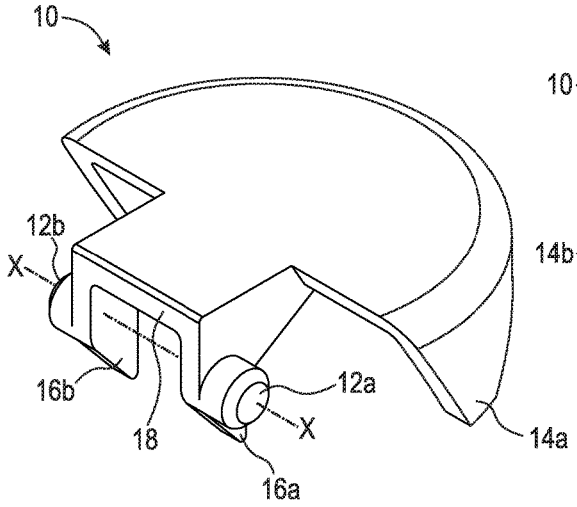
FIG. 3A is a front perspective view of a lid of the flip-top assembly shown in FIG. 1A, in accordance with an embodiment of the present invention.
Figure 3B:
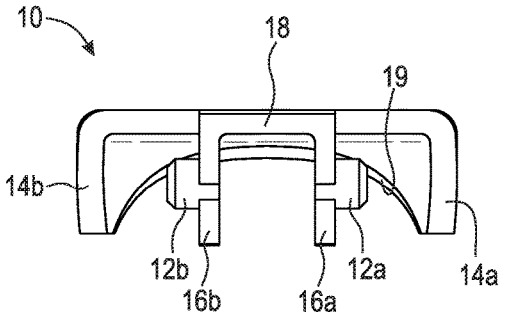
FIG. 3B is a front planar view of the lid shown in FIG. 3A, in accordance with an embodiment of the present invention.
Figure 3C:
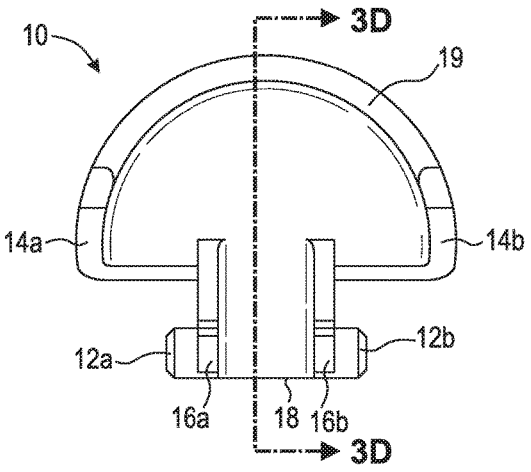
FIG. 3C is a bottom planar view of the lid shown in FIG. 3A, in accordance with an embodiment of the present invention.
Figure 3D:
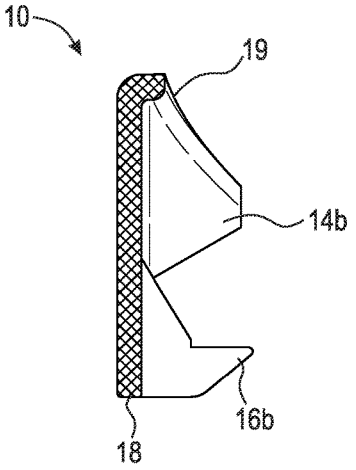
FIG. 3D is a cross-sectional view of the lid shown in FIG. 3A taken generally along line 3D-3D in FIG. 3C, in accordance with an embodiment of the present invention.

FIG. 3A is a front perspective view of lid 10 of flip-top assembly 100 as shown in FIG. 1A, in accordance with an embodiment of the present invention. FIG. 3B is a front planar view of lid 10 shown in FIG. 3A, FIG. 3C is a bottom planar view of lid 10 shown in FIG. 3A, and FIG. 3D is a cross-sectional view of lid 10 shown in FIG. 3A taken generally along line 3D-3D in FIG. 3C. In this exemplary embodiment, lid 10 comprises arms 12*a* and 12*b*, lateral wings 14*a* and 14*b*, legs 16*a* and 16*b*, lid front edge 18, and lid rear opening surface 19. Lid 10 is pivotably attached to cover 40 by arms 12*a* and 12*b* such that lid 10 is at least partially rotatable about axis X-X. Lid tabs 37*a* and 37*b* of pivot-spring 30 secure arms 12*a* and 12*b* in lid curved receptacles 44*a* and 44*b* of lid 40, respectively (see FIG. 7). Legs 16*a* and 16*b* straddle nozzle 24 of actuator 20 and can be used to prevent lid 10 from moving rotationally. Lid front edge 18 engages tongue 32 (see FIGS. 5A-5D) of pivot-spring 30 at spring interface 106. When a user's thumb is inserted into opening 102, lateral wings 14*a* and 14*b* are raised from interface 104 such that lid 10 disengages cover 40. Lid front edge 18 forces tongue 32 to bend elastically forward. When the user's thumb is removed from opening 102, the elasticity of tongue 32 returns lid 10 to the closed position.

Figure 4A:
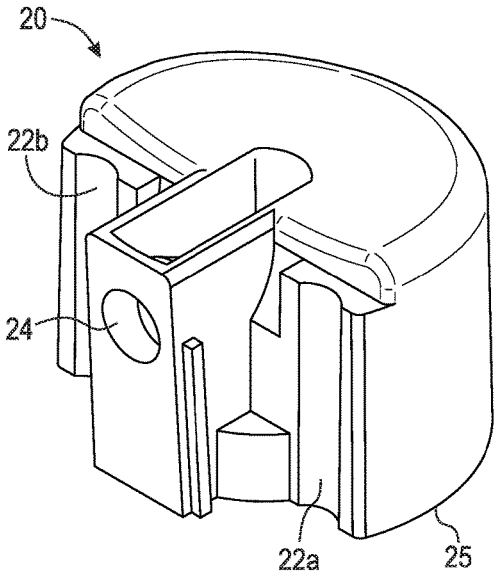
FIG. 4A is a front perspective view of an actuator of the flip-top assembly shown in FIG. 1A, in accordance with an embodiment of the present invention.
Figure 4B:
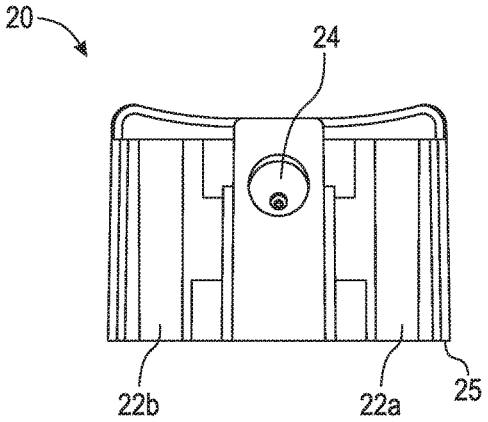
FIG. 4B is a front planar view of the actuator shown in FIG. 4A, in accordance with an embodiment of the present invention.
Figure 4C:
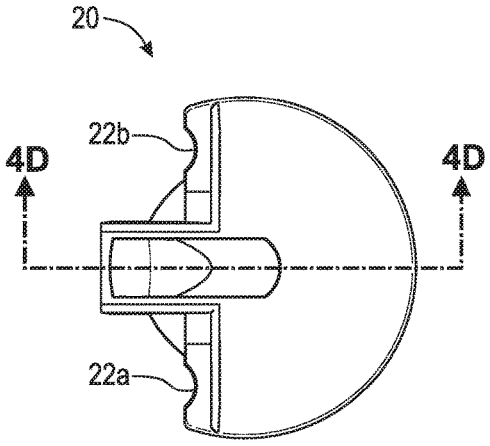
FIG. 4C is a top planar view of the actuator shown in FIG. 4A, in accordance with an embodiment of the present invention.
Figure 4D:
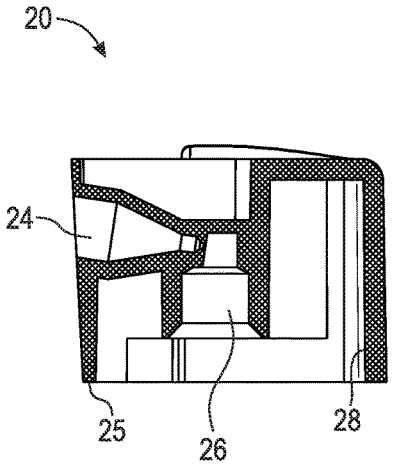
FIG. 4D is a cross-sectional view of the actuator shown in FIG. 4A taken generally along line 4D-4D in FIG. 4C, in accordance with an embodiment of the present invention.

FIG. 4A is a front perspective view of actuator 20 of flip-top assembly 100 as shown in FIG. 1A, in accordance with an embodiment of the present invention. FIG. 4B is a front planar view of actuator 20 shown in FIG. 4A, FIG. 4C is a top planar view of actuator 20 shown in FIG. 4A, and FIG. 4D is a cross-sectional view of actuator 20 shown in FIG. 4A taken generally along line 4D-4D in FIG. 4C. In this exemplary embodiment, actuator 20 comprises curvatures 22*a* and 22*b*, nozzle 24, bottom surface 25, receiving port 26, and actuator wall 28. Actuator 20 is assembled onto pivot-spring 30. Curvatures 22*a* and 22*b* are slid along dowels 38*a* and 38*b* (see FIGS. 5A-5D) of pivot-spring 30, respectively. Actuator wall 28 fits snuggly around guides 34*a*, 34*b*, and 34*c* such that actuator 20 can move axially with respect to pivot-spring 30. Nozzle 24 is always aligned with tongue opening 33. When actuator 20 is fully depressed, bottom surface 25 abuts against flange 35 (see FIGS. 5A-5D). Receiving port 26 is internally connected to nozzle 24 (see FIG. 4D) and is capable of engaging a stem of an aerosol canister such that the contents thereof are dispersible through nozzle 24.

Figure 5A:
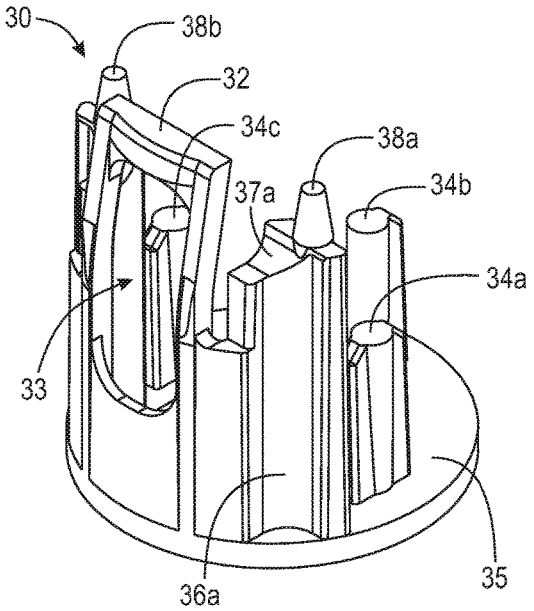
FIG. 5A is a front perspective view of a pivot-spring of the flip-top assembly shown in FIG. 1A, in accordance with an embodiment of the present invention.
Figure 5B:
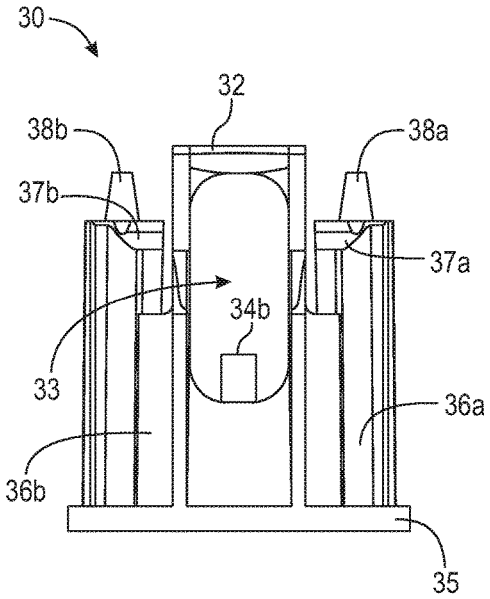
FIG. 5B is a front planar view of the pivot-spring shown in FIG. 5A, in accordance with an embodiment of the present invention.
Figure 5C:
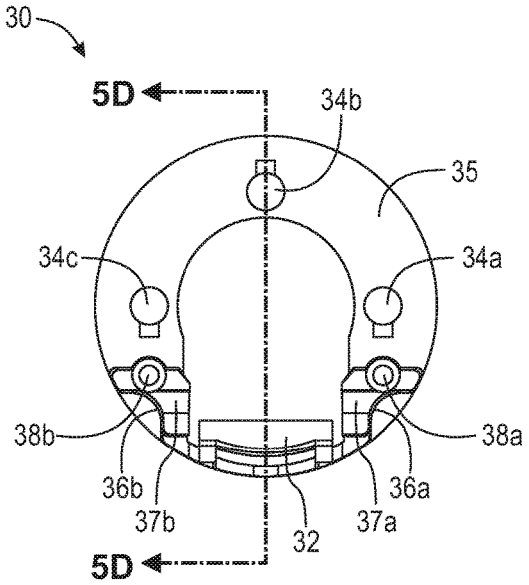
FIG. 5C is a top planar view of the pivot-spring shown in FIG. 5A, in accordance with an embodiment of the present invention.
Figure 5D:
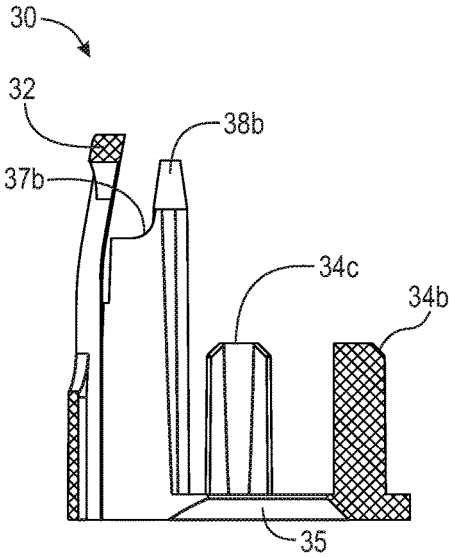
FIG. 5D is a cross-sectional view of the pivot-spring shown in FIG. 5A taken generally along line 5D-5D for FIG. 5C, in accordance with an embodiment of the present invention.

FIG. 5A is a front perspective view of pivot-spring 30 of flip-top assembly 100 as shown in FIG. 1A, in accordance with an embodiment of the present invention. FIG. 5B is a front planar view of pivot-spring 30 shown in FIG. 5A, FIG. 5C is a top planar view of pivot-spring 30 shown in FIG. 5A, and FIG. 5D is a cross-sectional view of pivot-spring 30 shown in FIG. 5A taken generally along line 5D-5D in FIG. 5C. In this exemplary embodiment, pivot-spring 30 comprises tongue 32, tongue opening 33, guides 34*a*, 34*b*, and 34*c*, flange 35, vertical curvatures 36*a* and 36*b*, lid tabs 37*a* and 37*b*, and dowels 38*a* and 38*b*. Tongue 32 is flexible and provides a biasing torque against lid 10 (shown in FIG. 1B) towards a closed position while dowels 38*a* and 38*b* are rigid and provide stability within cover 40. Dowels 38*a* and 38*b* engage cover top cavities 49*a* and 49*b*, respectively. Lid tabs 37*a* and 37*b* enclose arms 12*a* and 12*b* within lid curved receptacles 44*a* and 44*b*, respectively, such that lid 10 is at least partially rotatable with respect to cover 40, pivot-spring 30, and actuator 20. The geometry of tongue 32 enables pivot-spring 30 to be manufactured out of plastic instead of metal requiring an appropriate yield strength that is typically used in spring mechanisms. Tongue 32 is rectangular with at least one curved surface and is capable of elastically bending. Tongue opening 33 is a slot that runs longitudinally through tongue 32 such that tongue 32 bends with the appropriate spring constant for the desired required force and the contents of aerosol canister 50 can be dispersed. Guides 34*a*, 34*b*, and 34*c* and dowels 38*a* and 38*b* provide stability to actuator 20 during axial movement.

Figure 6A:
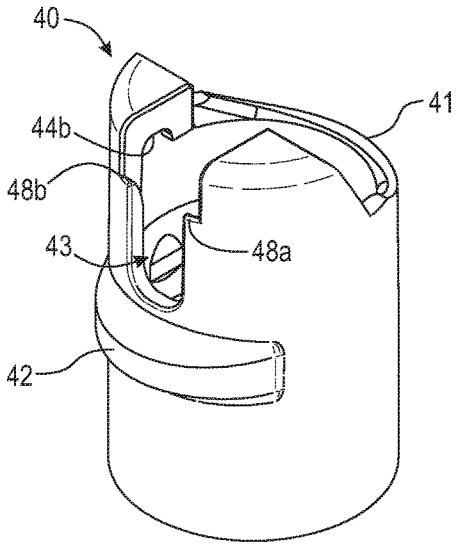
FIG. 6A is a front perspective view of a cover of the flip-top assembly shown in FIG. 1A, in accordance with an embodiment of the present invention.
Figure 6B:
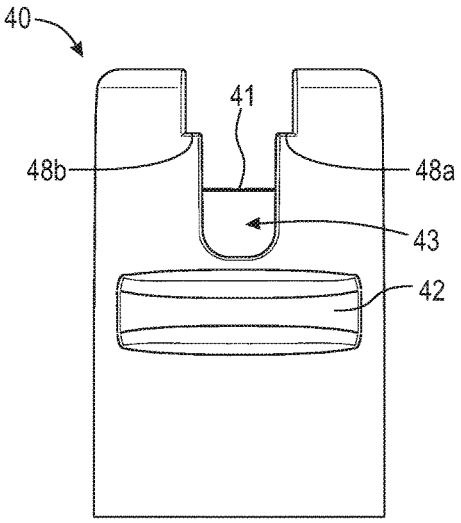
FIG. 6B is a front planar view of the cover shown in FIG. 6A, in accordance with an embodiment of the present invention.
Figure 6C:
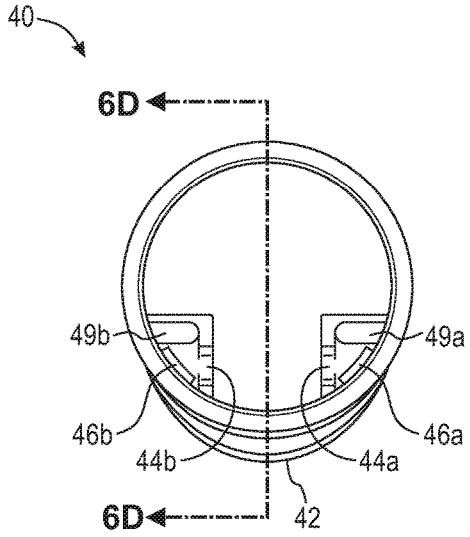
FIG. 6C is a bottom planar view of the cover shown in FIG. 6A, in accordance with an embodiment of the present invention.
Figure 6D:
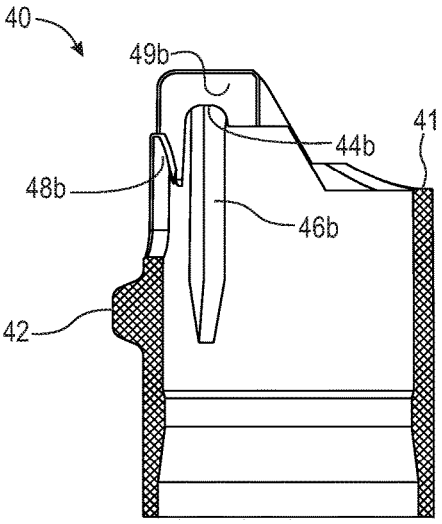
FIG. 6D is a cross-sectional view of the cover shown in FIG. 6A taken generally along line 6D-6D in FIG. 6C, in accordance with an embodiment of the present invention.

FIG. 6A is a front perspective view of cover 40 of flip-top assembly 100 as shown in FIG. 1A, in accordance with an embodiment of the present invention. FIG. 6B is a front planar view of cover 40 shown in FIG. 6A, FIG. 6C is a bottom planar view of cover 40 shown in FIG. 6A, and FIG. 6D is a cross-sectional view of cover 40 shown in FIG. 6A taken generally along line 6D-6D in FIG. 6C. In this exemplary embodiment, cover 40 comprises cover rear opening surface 41, finger ridge 42, cover front opening 43, lid curved receptacles 44*a* and 44*b*, vertical guides 46*a* and 46*b*, cover apexes 48*a* and 48*b*, and cover top cavities 49*a* and 49*b*. Cover 40 is generally a circular tube arranged to enclose a canister containing a substance under pressure. Cover front opening 43 enables nozzle 24 of actuator 20 to direct any dispelled material outward through flip-top assembly 100. Cover front opening 43 is slightly elongated in the axial direction to accommodate the upward and downward axial movement of nozzle 24 when a user depresses actuator 20 to actuate the expulsion of the material within aerosol canister 50 and then releases actuator 20 to cease the expulsion of material. Finger ridge 42 is a generally horizontal bump molded into cover 40 in order to increase the user's comfort while gripping flip-top assembly 100 and indicate the direction of nozzle 24. It should be appreciated, however, that finger ridge 42 does not have to be molded into cover 40. Instead, for example, finger ridge 42 can be added to cover 40 as a separate component after cover 40 is molded. Lid curved receptacles 44*a* and 44*b* are operatively arranged to receive arms 12*a* and 12*b*, respectively, such that lid 10 is at least partially rotatable with respect to cover 40. Vertical guides 46*a* and 46*b* help position pivot-spring 30 within cover 40. When inserting pivot-spring 30 into cover 40, vertical curvatures 36*a* and 36*b* are slid along vertical guides 46*a* and 46*b*, respectively. Dowels 38*a* and 38*b* engage cover top cavities 49*a* and 49*b*, respectively. Cover apexes 48*a* and 48*b* provide a pivot point for tongue 32 during elastic deformation. When the user's thumb is inserted into rear opening 102, lid 10 is lifted and lid front edge 18 engages tongue 32. Tongue 32 elastically bends around cover apexes 48*a* and 48*b* (see FIG. 1B).

Figure 7:
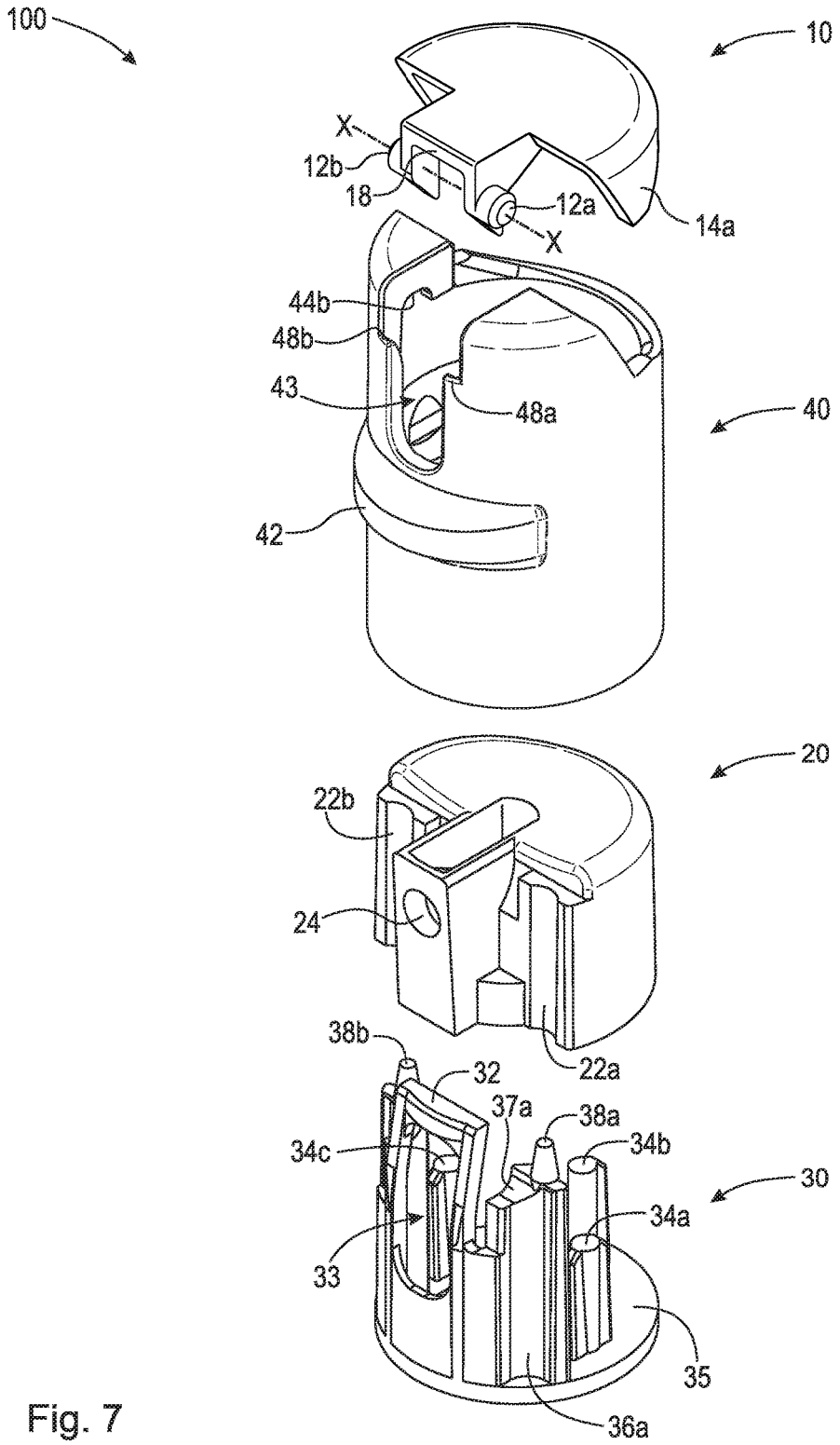
FIG. 7 is an exploded view of the flip-top assembly shown in FIG. 1A, in accordance with an embodiment of the present invention.

FIG. 7 is an exploded view of flip-top assembly 100 shown in FIG. 1A, in accordance with an embodiment of the present invention. Aerosol canister 50 (not shown) is inserted axially upwards through the bottom of cover 40. The stem of aerosol canister 50 is inserted into receiving port 26 of actuator 20. Nozzle 24 directs the discharged contents of aerosol canister 50 through tongue opening 33 and cover front opening 43.

Arms 12*a* and 12*b* fit into lid curved receptacles 44*a* and 44*b*, respectively, such that lid 10 is rotatable about axis X-X. In this exemplary embodiment, actuator 20 is assembled on pivot-spring 30 and non-rotatably secured by dowels 38*a* and 38*b* and guides 34*a*, 34*b*, and 34*c*. Curvatures 22*a* and 22*b* abut against dowels 38*a* and 38*b*, respectively. Guides 34*a*, 34*b*, and 34*c* abut against actuator wall 28 in three locations (e.g., at 90°, 180°, and 270°). Nozzle 24 aligns with tongue opening 33. When assembled, actuator 20 is axially moveable and nozzle 24 always aligns with tongue opening 33. Pivot-spring 30 is inserted in cover 40 such that lid tabs 37*a* and 37*b* enclose arms 12*a* and 12*b* in lid curved receptacles 44*a* and 44*b*, respectively. Vertical curvatures 36*a* and 36*b* abut against vertical guides 46*a* and 46*b* (see FIG. 6D), respectively.

Figure 8A:
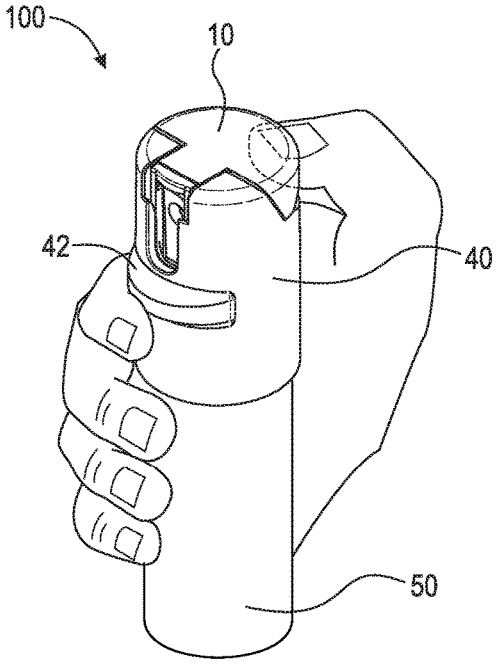
FIG. 8A is a front perspective view of the flip-top assembly shown in FIG. 2 being used, with a thumb partially inserted into the rear opening, in accordance with an embodiment of the present invention.
Figure 8B:
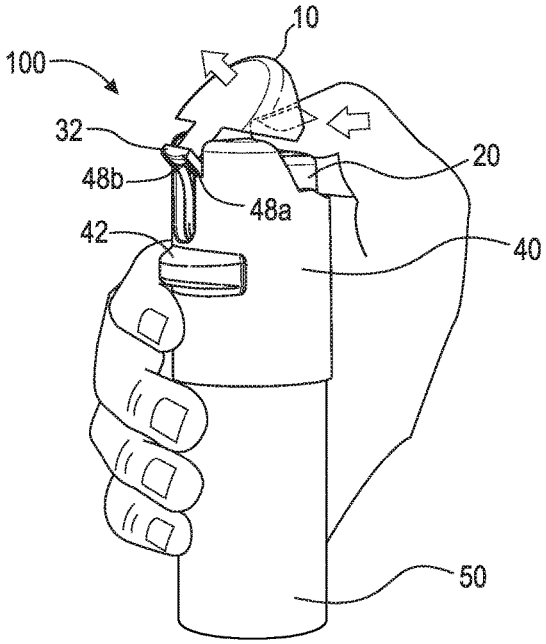
FIG. 8B is a front perspective view of the flip-top assembly shown in FIG. 2 being used, with a thumb fully inserted into the rear opening, in accordance with an embodiment of the present invention; and, FIG. 8C is a front perspective view of the flip-top assembly shown in FIG. 2 being used, with a thumb fully inserted into the rear opening and depressing the actuator, in accordance with an embodiment of the present invention.
Figure 8C:
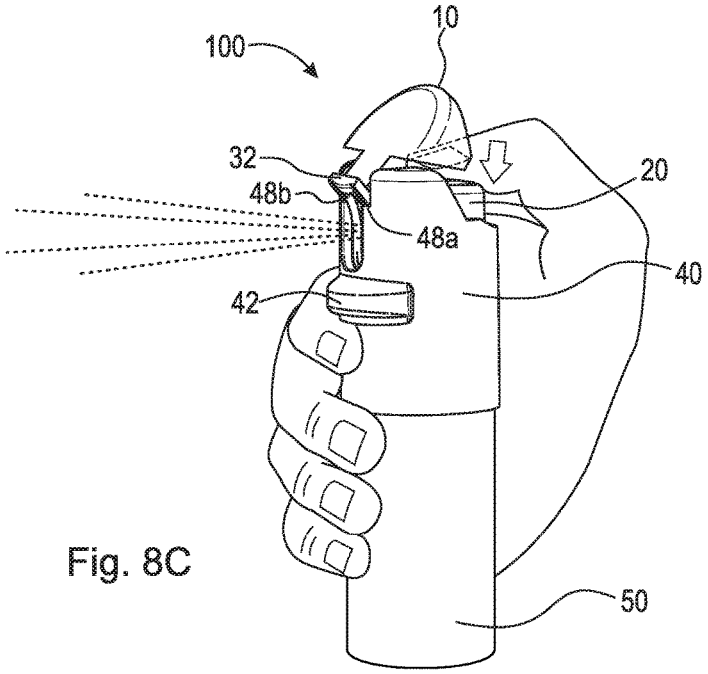

FIGS. 8A-8C illustrate aerosol canister 50 housed within flip-top assembly 100 and in the process of being used by a user. The user is shown holding flip-top assembly 100. The user's index finger is located just below finger ridge 42. To dispel the contents of aerosol canister 50, the user's thumb is inserted into rear opening 102 and depresses actuator 20.

FIG. 8A is a front perspective view of flip-top assembly 100 being used, with the user's thumb partially inserted into rear opening 102, in accordance with an embodiment of the present invention. Lid 10 is biased toward its closed position (shown in FIG. 1A) by tongue 32 of pivot-spring 30. The user must overcome the force of tongue 32 to open lid 10. The user can use a single substantially linear motion to insert the thumb into rear opening 102. The ease of a single substantially linear motion is especially important when aerosol canister 50 contains pepper spray and the user is presented with a threat.

FIG. 8B is a front perspective view of flip-top assembly 100, with the user's thumb fully inserted into rear opening 102, in accordance with an embodiment of the present invention. The tip of the user's thumb is in position to depress actuator 20. Lid 10 provides some downward force on the user's thumb because lid 10 is biased toward the closed position by tongue 32 of pivot-spring 30. Tongue 32 elastically bends around cover apexes 48*a* and 48*b*.

FIG. 8C is a front perspective view of flip-top assembly 100 being used, with the user's thumb fully inserted into rear opening 102 and depressing actuator 20, in accordance with an embodiment of the present invention. In this position, lid 10 provides some downward force on the user's thumb because lid 10 is biased toward the closed position by tongue 32 of pivot-spring 30. While the user is depressing actuator 20 in a downward axial direction, finger ridge 42 helps prevent cover 40 from slipping in the user's hand. FIG. 8C shows material being dispelled from aerosol canister 50 represented by dotted lines.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

10 Lid
12*a* Arm
12*b* Arm
14*a* Lateral Lid Wing
14*b* Lateral Lid Wing
16*a* Leg
16*b* Leg
18 Lid Front Edge
19 Lid Rear Opening Surface
20 Actuator
22*a* Curvature
22*b* Curvature
24 Nozzle
25 Bottom Surface
26 Receiving Port
28 Actuator Wall
30 Pivot-Spring
32 Tongue
33 Tongue Opening
34*a* Guide
34*b* Guide
34*c* Guide
35 Flange
36*a* Vertical Curvature
36*b* Vertical Curvature
37*a* Lid Tab
37*b* Lid Tab
38*a* Dowel
38*b* Dowel
40 Cover
41 Cover Rear Opening Surface
42 Finger Ridge
43 Cover Front Opening
44*a* Lid Curved Receptacle
44*b* Lid Curved Receptacle
46*a* Vertical Guide
46*b* Vertical Guide
48*a* Cover Apex
48*b* Cover Apex
49*a* Cover Top Cavity
49*b* Cover Top Cavity
50 Aerosol Canister
100 Flip-Top Assembly
102 Rear Opening
104 Interface
106 Spring Interface

What is claimed is:

1. A pivot-spring assembly for dispersing contents from an aerosol canister, comprising:
- a cover having an opening;
- a lid;
- a pivot-spring operatively arranged in the cover to rotatably secure the lid to the cover, the pivot-spring comprising:
  - a flexible tongue;
  - at least one tab operatively arranged to at least partially enclose at least one arm of the lid;
  - at least one dowel; and,
  - at least one guide, wherein the flexible tongue, the at least one lid tab, the at least one dowel, and the at least one guide are vertically arranged on a flange; and,
- an actuator having a nozzle and non-rotatably secured on the pivot-spring, the actuator operatively arranged to engage a stem of the aerosol canister and disperse contents from the aerosol canister.

2. The pivot-spring assembly as recited in claim 1, wherein the flexible tongue is operatively arranged to elastically deform when the lid is in an opened position.

3. The pivot-spring assembly as recited in claim 2, wherein the flexible tongue is operatively arranged to bias the lid to a closed position.

4. The pivot-spring assembly as recited in claim 2, wherein the actuator is axially movable along the at least one dowel and the at least one guide.

5. The pivot-spring assembly as recited in claim 1, wherein the cover comprises a finger ridge.

6. The pivot-spring assembly as recited in claim 2, wherein the flexible tongue is made of plastic.

7. A case for a canister capable of dispelling material, comprising:
- a main body to house the canister, the main body having a front aperture;
- a top lid to cover the main body, the top lid having at least one arm;
- a spring non-rotatably secured to the main body and rotatably secured to the top lid, the spring comprising:
  - a flexible tongue;
  - at least one lid tab operatively arranged to at least partially enclose the at least one arm;
  - at least one dowel; and,
  - at least one guide, wherein the flexible tongue, the at least one lid tab, the at least one dowel, and the at least one guide are vertically arranged on a flange; and,
- an actuator to direct dispelled material from the canister out of the main body through the front aperture.

8. The pivot-spring assembly as recited in claim 7, wherein the flexible tongue is operatively arranged to elastically deform when the top lid is in an opened position.

9. The case as recited in claim 7, wherein the flexible tongue asserts a biasing torque on the top lid toward a closed position.

10. The pivot-spring assembly as recited in claim 7, wherein the actuator is axially movable along the at least one dowel and the at least one guide.

11. The pivot-spring assembly as recited in claim 7, wherein the main body comprises a finger ridge.

12. The pivot-spring assembly as recited in claim 7, wherein the flexible tongue is made of plastic.

* * * * *